US012778258B2

(12) United States Patent
Huang et al.

(10) Patent No.: US 12,778,258 B2
(45) Date of Patent: Nov. 3, 2026

(54) HAIRDRESSING DEVICE

(71) Applicant: Thumbs Up Innovations Technology Co., Ltd., Zhuhai (CN)

(72) Inventors: Jiacheng Huang, Zhuhai (CN); Lilin Xu, Zhuhai (CN); Xiu Zou, Zhuhai (CN)

(73) Assignee: Thumbs Up Innovations Technology Co., Ltd., Zhuhai (CN)

( * ) Notice: Subject to any disclaimer, the term of this patent is extended or adjusted under 35 U.S.C. 154(b) by 68 days.

(21) Appl. No.: 18/936,285

(22) Filed: Nov. 4, 2024

(65) Prior Publication Data

US 2026/0108036 A1 Apr. 23, 2026

(30) Foreign Application Priority Data

Oct. 21, 2024 (CN) ..... 202422544992.6

(51) Int. Cl.
*A45D 2/36* (2006.01)

(52) U.S. Cl.
CPC ..... *A45D 2/367* (2013.01)

(58) Field of Classification Search
CPC ..... A45D 2/367
See application file for complete search history.

(56) References Cited

U.S. PATENT DOCUMENTS

2010/0170883 A1* 7/2010 Legrain ..... A45D 2/367 132/232
2024/0415258 A1* 12/2024 Fu ..... A45D 1/04

FOREIGN PATENT DOCUMENTS

CN 115153172 A * 10/2022 ..... A45D 6/00
CN 117617659 A * 3/2024 ..... A45D 6/00
KR 200474602 Y1 * 9/2014 ..... A45D 2/367

OTHER PUBLICATIONS

Why use a concave vs flat mating target for pogo pins, (Electrical Engineering), 2 pages. Jan. 3, 2023 [retrieved Mar. 10, 2026], Retrieved from the Internet: URL: <https://electronics.stackexchange.com/questions/459496/why-use-a-concave-vs-flat-mating-target-for-pogo-pins> (Year: 2023).*

(Continued)

*Primary Examiner* — Eric J Rosen
*Assistant Examiner* — Courtney N Huynh

(57) ABSTRACT

A hairdressing device includes a handle and a hairdressing head. The handle is equipped with a first circuit board, a driving mechanism, and a connecting component. The hairdressing head is detachably connected to the connecting component. The connecting component is connected to the driving mechanism. The driving mechanism is electrically connected to the first circuit board. The hairdressing head rotates together when the driving mechanism drives the connecting component to rotate. A heating member is provided on the hairdressing head. A conductive component is provided between the hairdressing head and the connecting component. The conductive component includes first conductive members for conducting electricity and elastic second conductive members. The first conductive member abuts against the second conductive member when the hairdressing head is assembled with the handle. The first circuit board is electrically connected to the heating member when the first conductive member abuts against the second conductive member.

14 Claims, 11 Drawing Sheets

(56) References Cited

OTHER PUBLICATIONS

KR 200474602 Y1 (Jeonmin) Radiating Pipe for Having Fever Hair Rod, Sep. 29, 2014. [retrieved on Mar. 3, 2026], Translation retrieved from: Espacenet (Year: 2014).*
CN 115153172 A (Feng Ye) (Shenzhen Lady Merry Tech Co Ltd) Hair curler, Oct. 11, 2022. [retrieved on Mar. 9, 2026], Translation retrieved from: Espacenet (Year: 2022).*
CN 117617659 A (Lai Weiming; Liao Shengwang) (Jiangxi Shengming Electronic Tech Co Ltd) Automatic curling iron, Mar. 1, 2024. [retrieved on Mar. 3, 2026], Translation retrieved from: Espacenet (Year: 2024).*

* cited by examiner

HAIRDRESSING DEVICE

CROSS-REFERENCE TO RELATED APPLICATIONS

The application claims priority of Chinese patent application CN2024225449926, filed on 2024-10-21, which is incorporated herein by reference in its entireties.

TECHNICAL FIELD

The present invention relates to the technical field of hairdressing tools, particularly to a hairdressing device.

BACKGROUND ART

With the development of society and the improvement of living standards, people's aesthetic standards have gradually increased, and personality and fashion have become the trends pursued by contemporary beauty enthusiasts. Designing hair into various fashionable hairstyles can make people look more personalized and enhance their beauty. Curly hair styling made with the help of electric hairdressing devices is one of the most popular hairstyles at present.

In the prior art, in order to adapt to different diameters of curling irons for use, a handle part of an existing electric curling iron is detachably connected to a heating hairdressing head accessory, so that users can replace different heating hairdressing head accessories for use. However, at present, the electrical connection between the handle part and the heating hairdressing head accessory of the existing electric curling iron is mainly through hard contact, and there is no elastic deformation between the two parts. That is, the electrical connection between the two parts is achieved through the contact of two metal contact sheets arranged at a front and a back or the contact of metal shafts on both ends. However, this electrical connection method has a small controllable range for a size of a connection part between the handle part and the heating hairdressing head accessory, which makes production difficult to control, and is easy to cause poor contact between the heating hairdressing head accessory and a main body of the handle, affecting the service life of the product.

SUMMARY

The main purpose of the present invention is to provide a hairdressing device for solving a problem of poor contact caused by the use of hard contact in electrical connection between a handle part and a heating hairdressing head accessory of an existing curling iron.

In order to solve the above technical problem, a technical solution provided by the present invention is as follows.

A hairdressing device includes a handle and a hairdressing head.

The handle is equipped with a first circuit board, a driving mechanism, and a connecting component. The hairdressing head is detachably connected to the connecting component, and the connecting component is connected to the driving mechanism. The driving mechanism is electrically connected to the first circuit board, and the hairdressing head rotates together when the driving mechanism drives the connecting component to rotate.

A heating member for heating is provided on the hairdressing head, and a conductive component is provided between the hairdressing head and the connecting component. The conductive component includes first conductive members for conducting electricity and second conductive members having elasticity. The first conductive member abuts against the second conductive member when the hairdressing head is assembled with the handle. The first circuit board is electrically connected to the heating member when the first conductive member abuts against the second conductive member.

Furthermore, the connecting component includes a first connecting member and a second connecting member both arranged on the handle. The hairdressing head is detachably connected to the first connecting member. The driving mechanism is connected to the first connecting member after passing through the second connecting member. The second connecting member is fixed on the handle.

The first conductive member is arranged on the first connecting member, and the second conductive member is arranged on the hairdressing head. The first connecting member is provided with a conductive ring on one side close to the second connecting member. The conductive ring is used for conducting electricity and is in an annular shape. The conductive ring is electrically connected to the first conductive member, and a center of the conductive ring is positioned on a central axis of rotation of the hairdressing head. The second connecting member is provided with a third conductive member that has elasticity and is used for conducting electricity. The third conductive member abuts against the conductive ring. When the driving mechanism drives the first connecting member to rotate, the hairdressing head rotates. The third conductive member is electrically connected to the first circuit board.

Furthermore, both the second conductive member and the third conductive member are elastic probes, and the first conductive member is a conductive column.

Furthermore, a surface of the first conductive member abutting against the second conductive member is recessed towards one side away from the second conductive member.

Furthermore, a cross-section of the first conductive member on the surface abutting against the second conductive member is V-shaped.

Furthermore, the hairdressing head is provided with a connecting head at one end near the handle, and an insertion end is provided on the connecting head. The second conductive member is provided on the insertion end. The connecting component is provided with an insertion opening used in conjunction with the insertion end. The first conductive member is arranged inside the insertion opening, and the second conductive member abuts against the first conductive member when the insertion end is placed inside the insertion opening.

Furthermore, the connecting head is provided with an engaging opening on an outer side corresponding to the insertion end, and the connecting component is provided with an engaging member. One end of the engaging member is provided on the first connecting member, and an opposite end of the engaging member is provided with an engaging hook. The engaging member is provided with a first pressing part at a position near the engaging hook, and an avoidance opening is defined in the first connecting member for avoiding the first pressing part.

When the insertion end is placed in the insertion opening, the engaging hook is placed in the engaging opening. When the first pressing part is pressed, the engaging hook is disengaged from the engaging opening.

Furthermore, the first connecting member includes a connecting seat, a second circuit board, and a position limiting bracket. The insertion opening is defined in the connecting seat, the position limiting bracket is arranged at an end of the connecting seat, and the second circuit board is positioned between the position limiting bracket and the connecting seat. The first conductive member is arranged on the second circuit board, and the first conductive member is partially placed inside the insertion opening. The conductive ring is arranged on the position limiting bracket, and the driving mechanism is connected to the position limiting bracket after passing through the second connecting member.

Furthermore, the first conductive member, the second conductive member, the third conductive member, and the conductive ring are all four in number. Each of the third conductive members is electrically connected to one second conductive member after passing through one conductive ring and one first conductive member.

The four conductive rings are respectively a first ring, a second ring, a third ring, and a fourth ring. The first ring, the second ring, the third ring, and the fourth ring are sequentially arranged on the position limiting bracket at intervals from outside to inside.

A temperature sensor is also provided inside the hairdressing head. Two of the second conductive members are electrically connected to a positive pole and a negative pole of the temperature sensor, and remaining two of the second conductive members are electrically connected to a positive pole and a negative pole of the heating member.

Furthermore, an end of the position limiting bracket is provided with a first column and a second column positioned outside the first column. The position limiting bracket is provided with a first annular groove and a second annular groove on an outer side of the second column. The first annular groove and the second annular groove are spaced apart.

The first ring is placed in the first annular groove, the second ring is placed in the second annular groove, the third ring is arranged on the second column, and the fourth ring is arranged on the first column.

The position limiting bracket is provided with passing holes at positions corresponding to the first ring, the second ring, the third ring, and the fourth ring, respectively. The first ring, the second ring, the third ring, and the fourth ring are each partially threaded through the passing holes and then arranged on the second circuit board. The first ring, the second ring, the third ring, and the fourth ring are each electrically connected to one first conductive member.

Furthermore, an end of the second connecting member is provided with a third circuit board. The third conductive member is provided on the third circuit board. The third circuit board is electrically connected to the first circuit board.

Furthermore, the third ring is sleeved on an outer side wall of the second column, and the fourth ring is sleeved on an outer side wall of the first column.

The four third conductive members are respectively a first probe, a second probe, a first clamping member, and a second clamping member. The first probe abuts against the first ring, and the second probe abuts against the second ring.

The first clamping member includes a first base and two first clamping arms extending from both sides of the first base. The two first clamping arms are clamped on an outer side wall of the third ring.

The second clamping member includes a second base and two second clamping arms extending from both sides of the second base. The two second clamping arms are clamped on an outer side wall of the fourth ring.

Furthermore, the first connecting member further includes a connecting outer sleeve. The connecting outer sleeve is connected to the connecting seat. The connecting outer sleeve is positioned at one end of the handle near the hairdressing head, and the avoidance opening is defined in the connecting outer sleeve.

Furthermore, the handle is provided with a first position limiting block, and an outer side wall of the first connecting member is provided with a second position limiting block. The second position limiting block is positioned on one side of the first position limiting block close to the hairdressing head.

Furthermore, the driving mechanism is a motor, and the first circuit board is positioned at one end of the driving mechanism away from the hairdressing head. The handle is equipped with a power cord for connecting to a power source. The power cord is electrically connected to the first circuit board.

Furthermore, the handle is equipped with a temperature operating member for adjusting a heating temperature of the heating member and a direction operating member for controlling a rotation direction of the driving mechanism. Both the temperature operating member and the direction operating member are electrically connected to the first circuit board. The handle is also provided with a restoration operating member for restoring to an initial state and a speed adjusting operating member for adjusting a rotational speed of output of the driving mechanism. The restoration operating member and the speed adjusting operating member are both electrically connected to the first circuit board.

Furthermore, the connecting head is rotationally provided with a clamping member used in conjunction with the hairdressing head for clamping hair.

Furthermore, the clamping member is provided with a second pressing part at a position near the handle. The second pressing part is arranged on the connecting head through a shaft rod, and a torsion spring is sleeved on the shaft rod. Two ends of the torsion spring respectively abut against the second pressing part and the connecting head.

Furthermore, the hairdressing head includes a hair curling cylinder and two heat-conducting members. The heating member and the heat-conducting member are both disposed inside the hair curling cylinder, and the heating member is positioned between the two heat-conducting members. Two side surfaces of the heating member are in contact with the two heat-conducting members, respectively. The two heat-conducting members both abut against the hair curling cylinder. The connecting head is disposed at one end of the hair curling cylinder.

Furthermore, each of the heat-conducting members includes a base plate and two arc-shaped front plates formed by extending upward from both sides of the base plate. The two arc-shaped front plates both abut against an inner side wall of the hair curling cylinder, and the heating member is positioned between the two base plates and is in contact with the base plates.

The present invention has the following beneficial effects. Compared with the prior art, in the present invention, by detachably connecting the hairdressing head to the connecting component, the hairdressing head can be detachably connected to the handle, so that the handle can be used with various styles of hairdressing heads, allowing different hairdressing heads to be adapted for use by a user according to a size of curly hair. Additionally, the hairdressing head and the handle are detachable, making it easy to carry and transport the hairdressing tool in this embodiment. Furthermore, in this embodiment, the elastic second conductive member is used in conjunction with the first conductive member, so that when the hairdressing head is assembled with the connecting component, the first conductive member is in close contact with the second conductive member, which prevents poor contact between the heating member and the first circuit board, allowing the heating member to be heated under the driving of the first circuit board, and achieving a hairdressing function of the hairdressing device.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
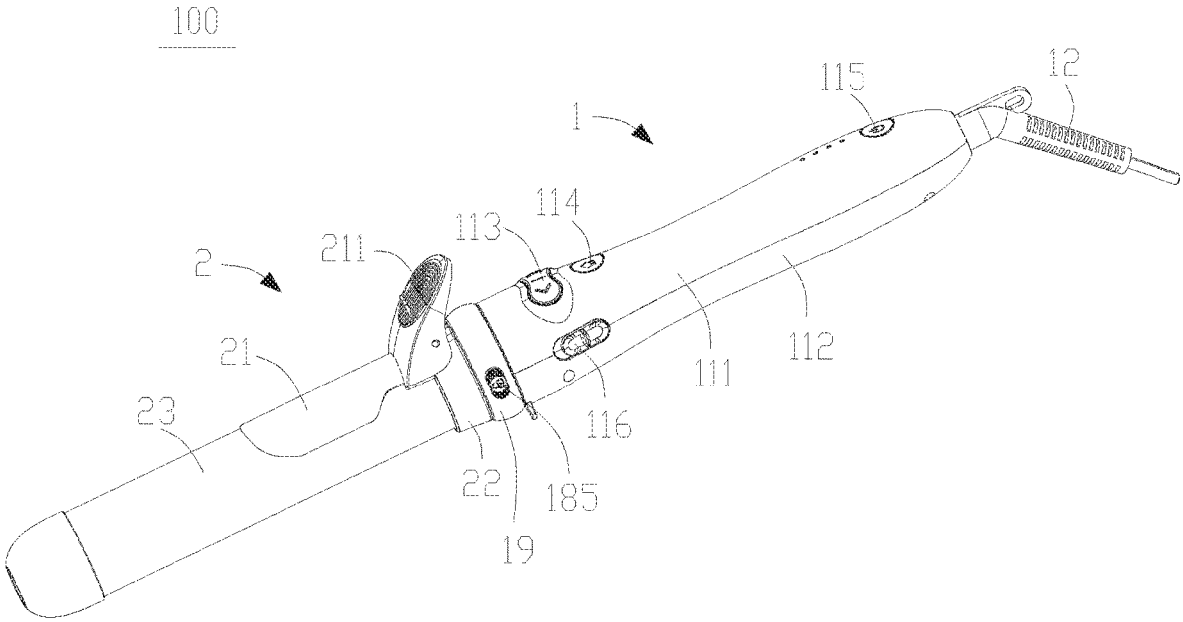
FIG. 1 is a perspective view of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
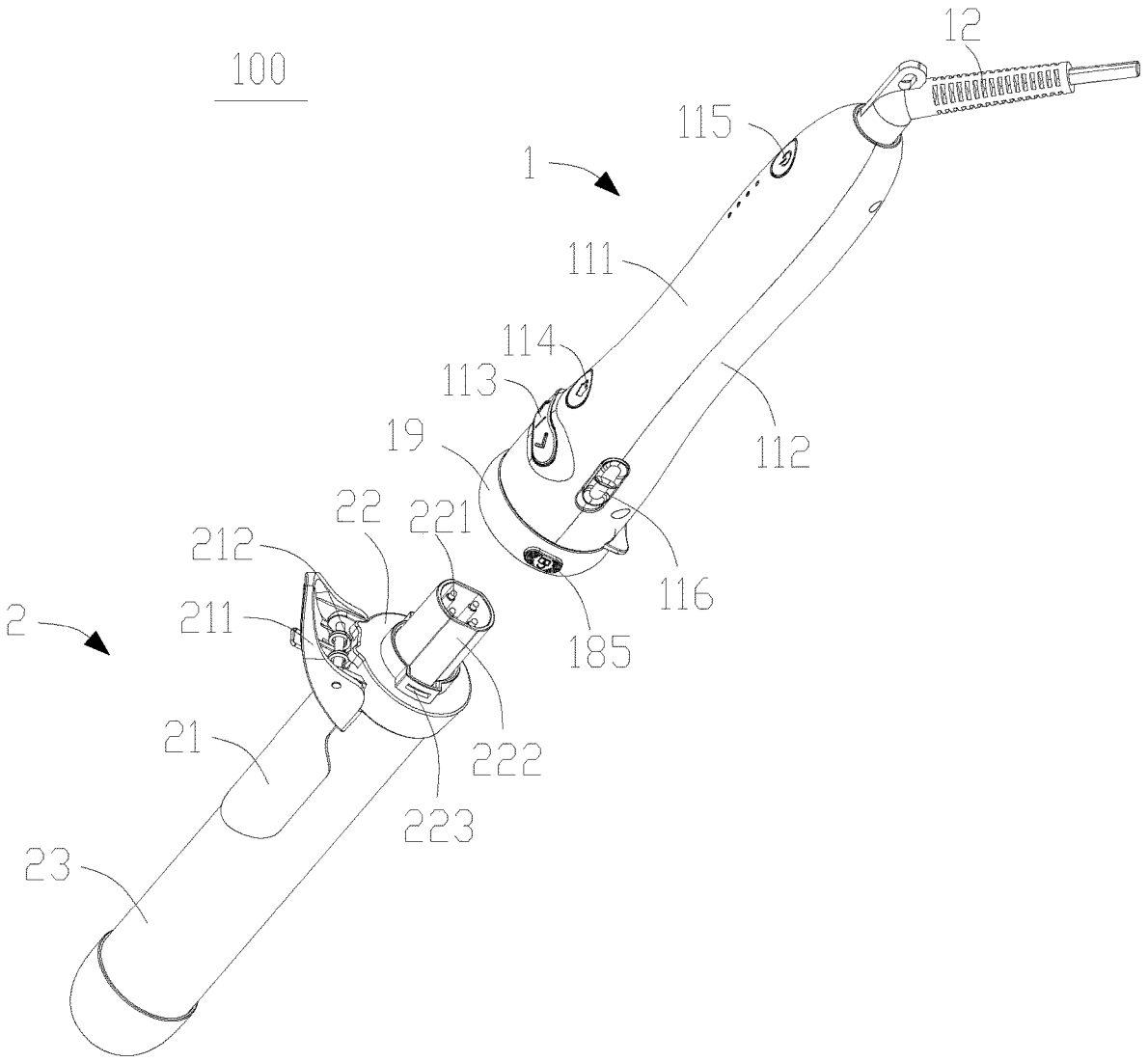
FIG. 2 is an exploded view of a hairdressing head and a handle of the present invention.
Figure 3:
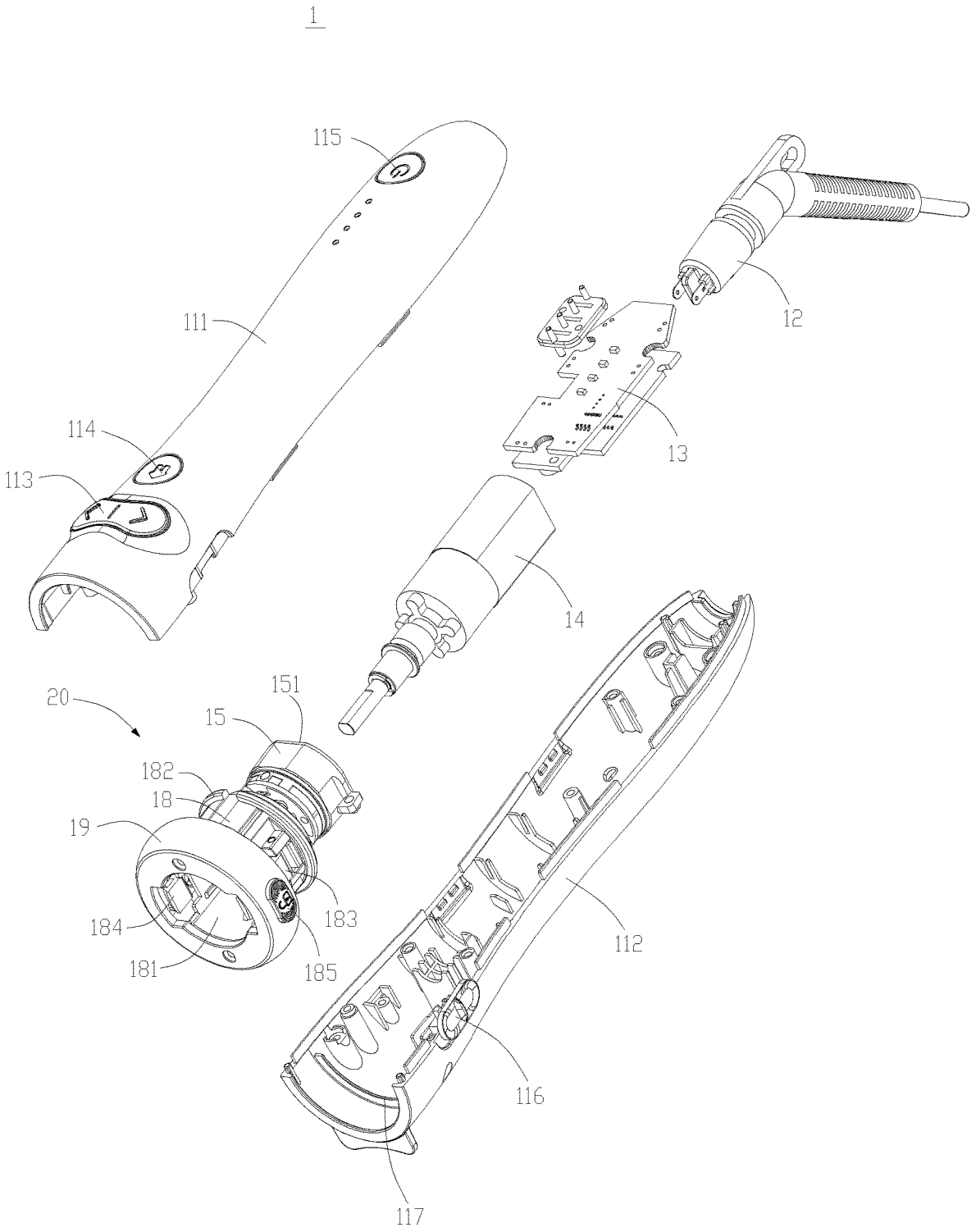
FIG. 3 is an exploded view of a handle of the present invention.
Figure 4:
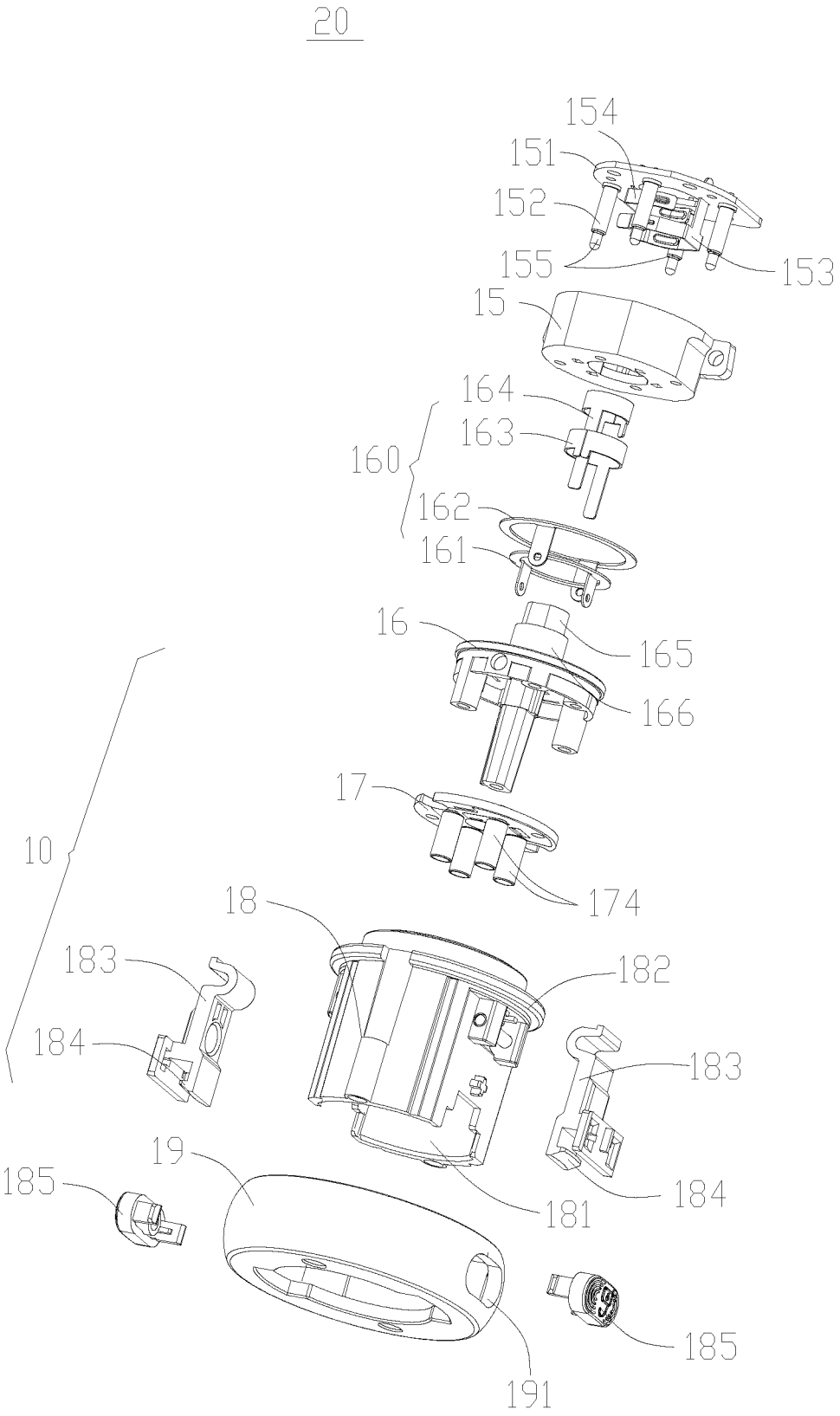
FIG. 4 is an exploded view of a connecting component, a first conductive member, a conductive ring, a third conductive member, and a third circuit board of the present invention.
Figure 5:
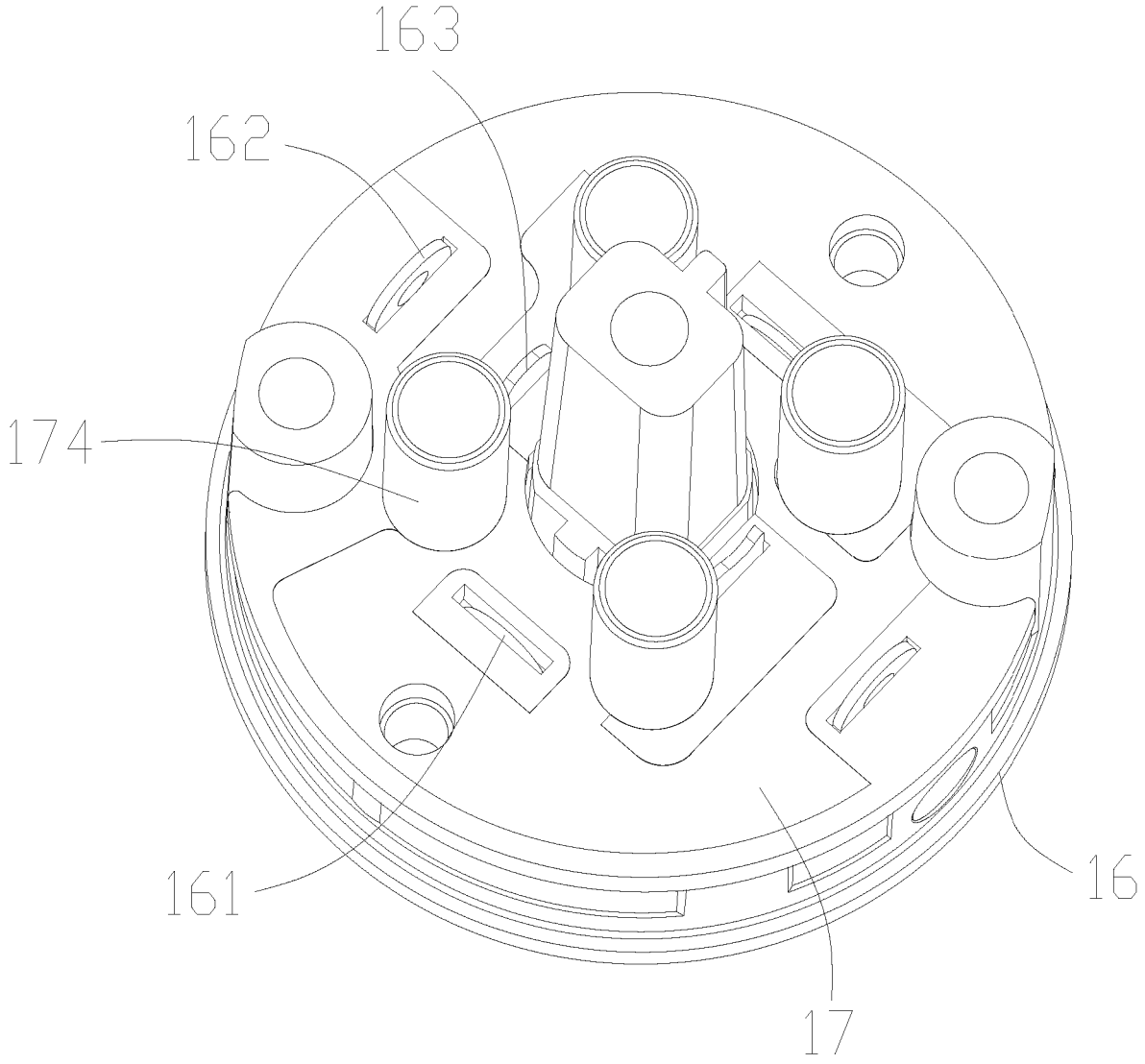
FIG. 5 is an assembly diagram of four conductive rings, four first conductive members, a second circuit board, and a position limiting bracket of the present invention.
Figure 6:
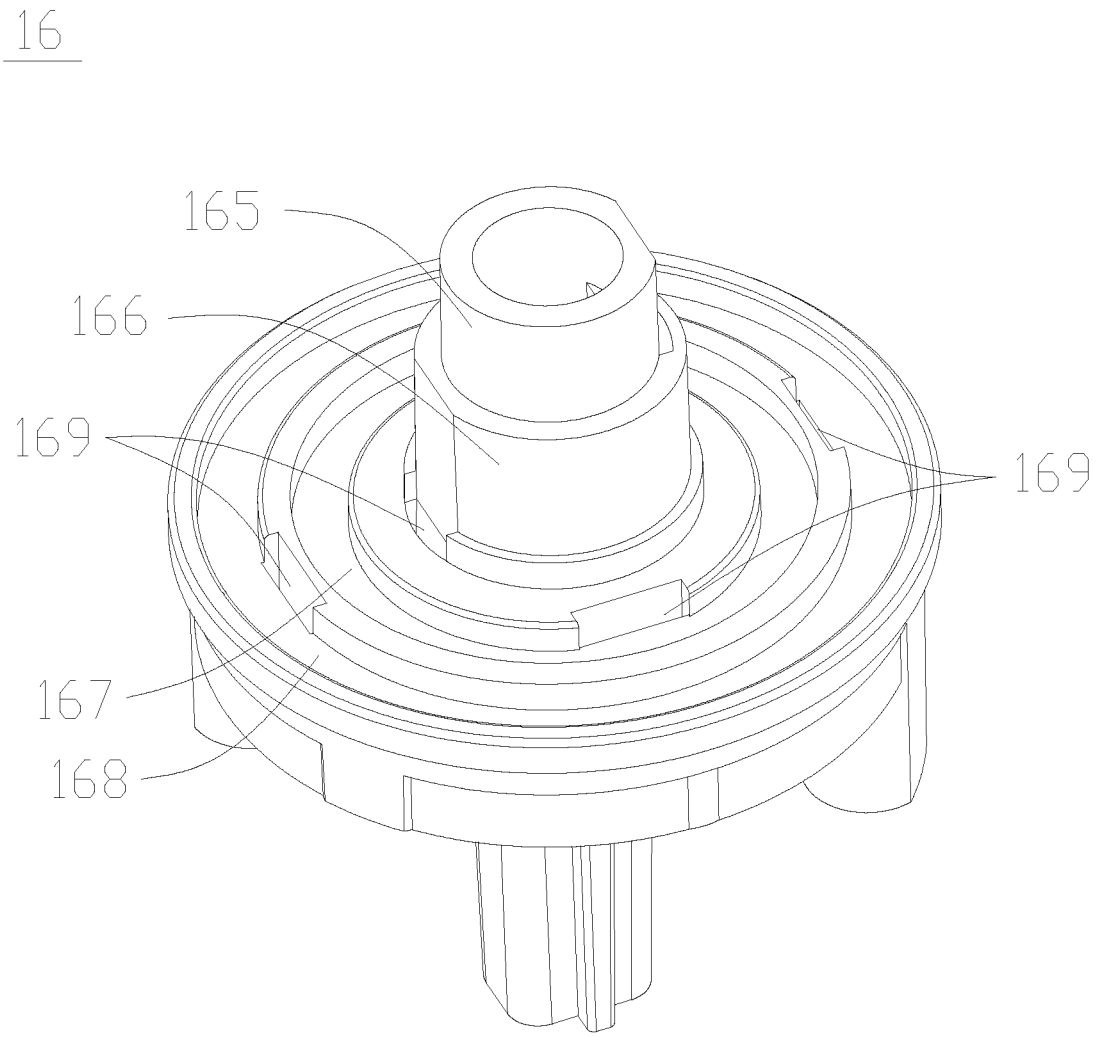
FIG. 6 is a structural diagram of a position limiting bracket of the present invention.
Figure 7:
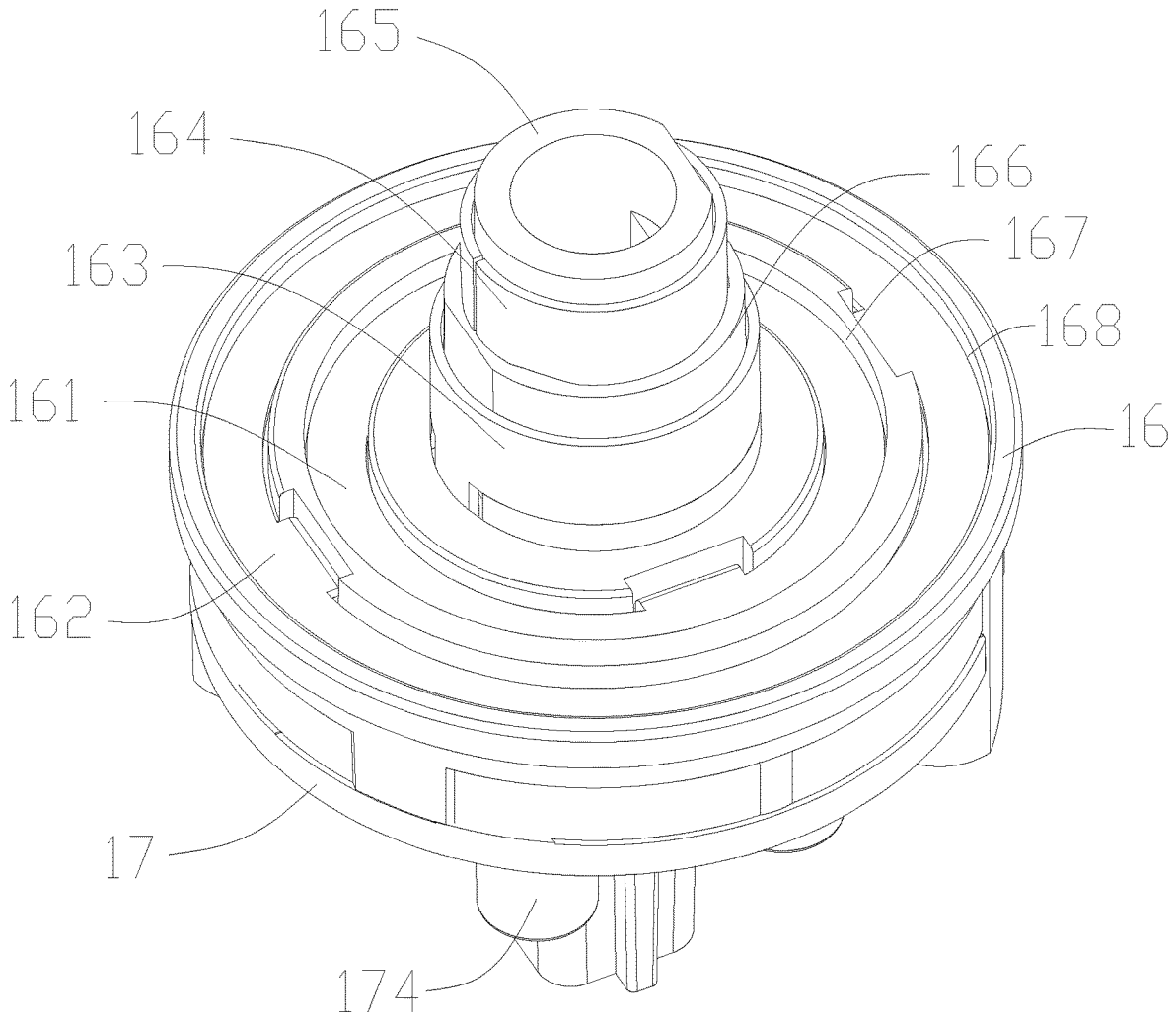
FIG. 7 is an assembly diagram of four conductive rings, four first conductive members, a second circuit board, and a position limiting bracket of the present invention from another angle of view.
Figure 8:
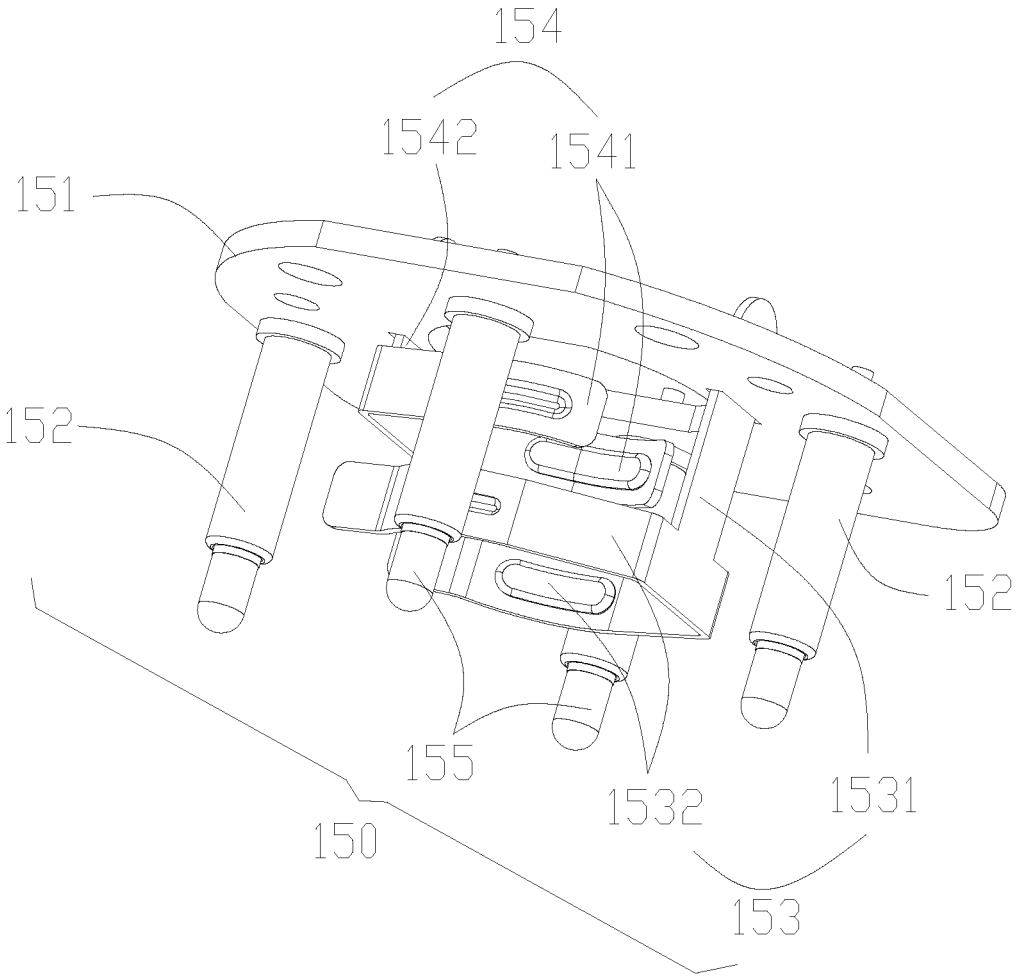
FIG. 8 is an assembly diagram of a third conductive member and a third circuit board of the present invention.
Figure 9:
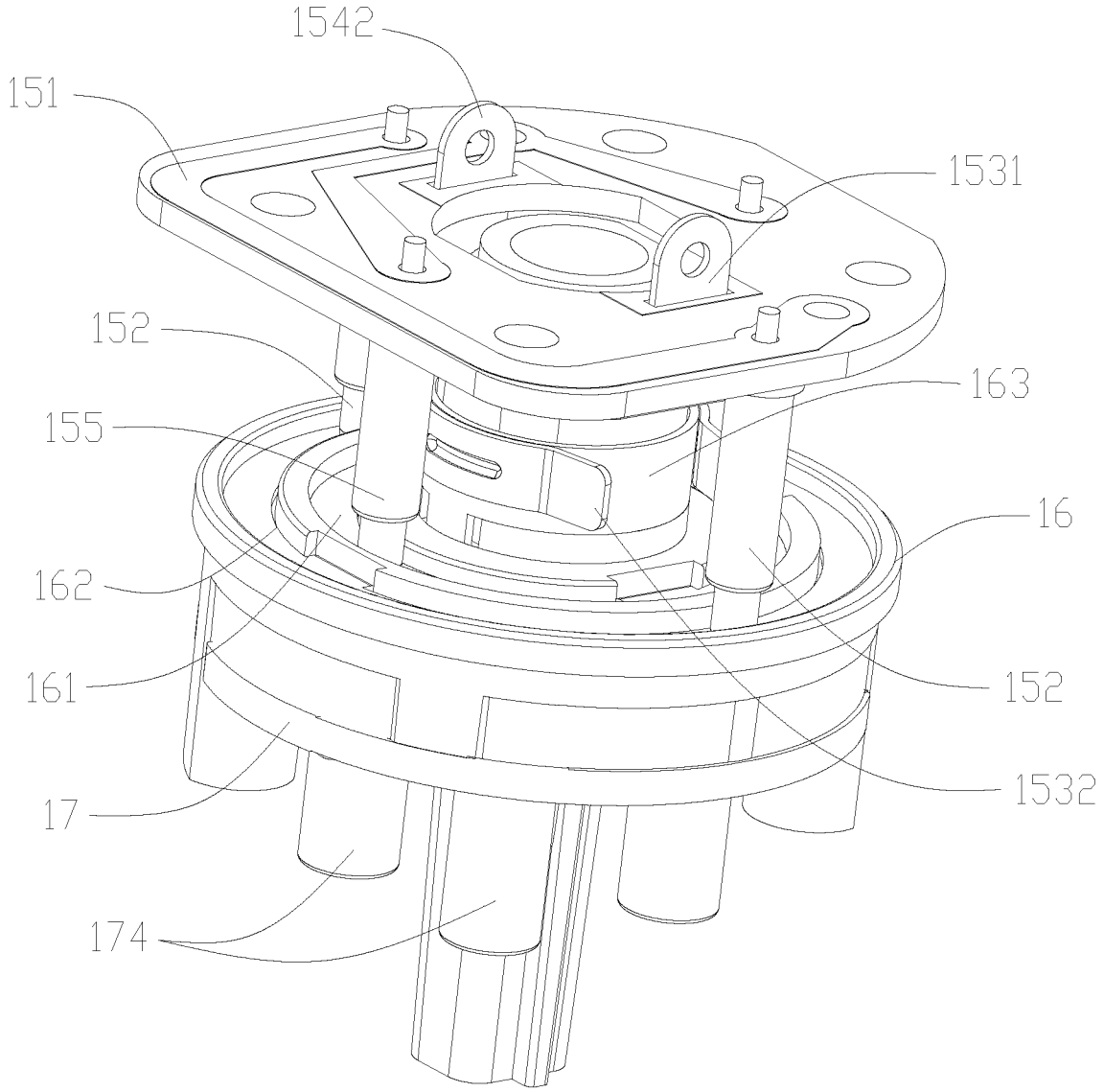
FIG. 9 is an assembly diagram of a third conductive member, a conductive ring, a third circuit board, a first conductive member, a second circuit board, and a position limiting bracket of the present invention.
Figure 10:
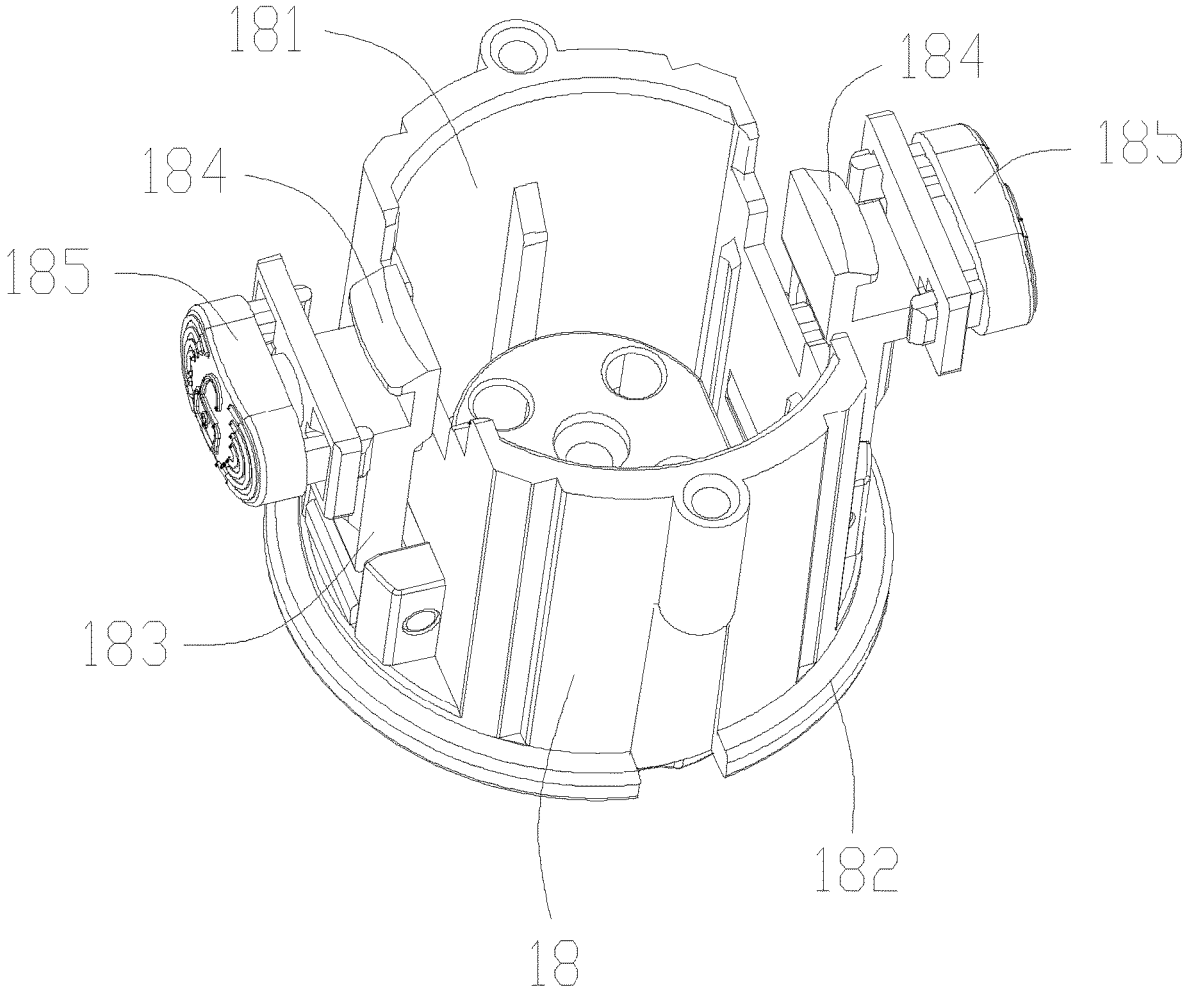
FIG. 10 is an assembly diagram of a connecting seat, a second pressing part, and an engaging member of the present invention.
Figure 11:
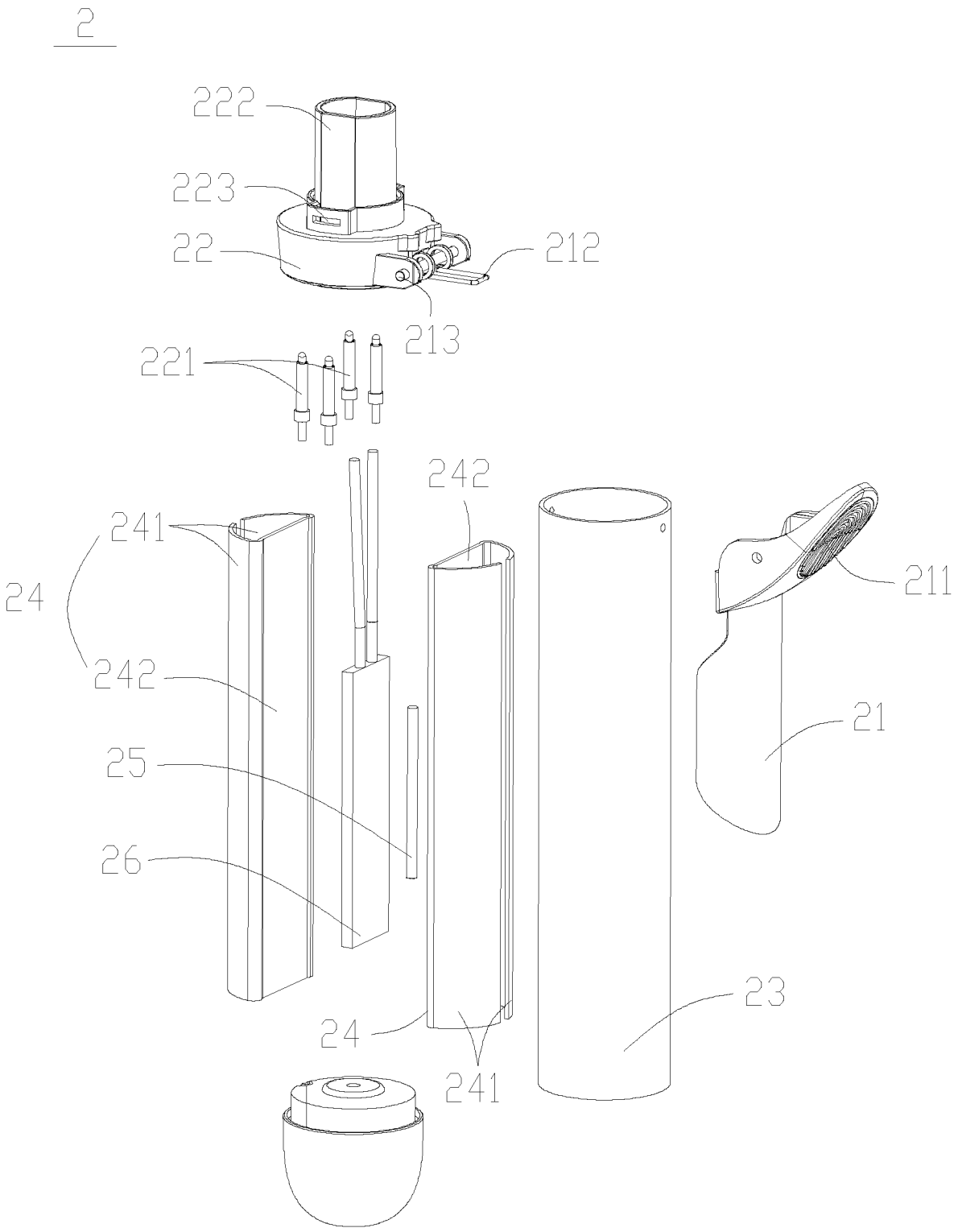
FIG. 11 is an exploded view of a hairdressing head of the present invention.

Referring to FIGS. 1-11, a hairdressing device 100 is provided in an embodiment of the present invention.

The hairdressing device 100 includes a handle 1 and a hairdressing head 2. The handle 1 is equipped with a first circuit board 13, a driving mechanism 14, and a connecting component 20. The hairdressing head 2 is detachably connected to the connecting component 20, and the connecting component 20 is connected to the driving mechanism 14. The driving mechanism 14 is electrically connected to the first circuit board 13, and the hairdressing head 2 rotates together when the driving mechanism 14 drives the connecting component 20 to rotate. A heating member 26 for heating is provided on the hairdressing head 2, and a conductive component is provided between the hairdressing head 2 and the connecting component 20. The conductive component includes first conductive members 174 for conducting electricity and second conductive members 221 for conducting electricity and having elasticity. The first conductive member 174 abuts against the second conductive member 221 when the hairdressing head 2 is assembled with the handle 1, and the first circuit board 13 is electrically connected to the heating member 26 when the first conductive member 174 abuts against the second conductive member 221.

In this embodiment, by detachably connecting the hairdressing head 2 to the connecting component 20, the hairdressing head 2 can be detachably connected to the handle 1, so that the handle 1 can be used with various styles of hairdressing heads 2, allowing different hairdressing heads 2 to be adapted for use by a user according to different degrees of curvature of curly hair. Additionally, the hairdressing head 2 and the handle 1 are detachable, making it easy to carry and transport the hairdressing tool in this embodiment. Furthermore, in this embodiment, the elastic second conductive member 221 is used in conjunction with the first conductive member 174, so that when the hairdressing head 2 is assembled with the connecting component 20, the first conductive member 174 is in close contact with the second conductive member 221, which prevents poor contact between the heating member 26 and the first circuit board 13, and can allow the heating member 26 to be heated under the driving of the first circuit board 13, achieving a hairdressing function of the hairdressing device 100. This effectively solves the problem of poor contact caused by hard contact in the electrical connection between a handle part and a heating hairdressing head of an existing curling iron. Moreover, by utilizing the elastic second conductive member 221, a controllable range of dimensional accuracy between the connecting component 20 and the hairdressing head 2 can be enlarged without affecting the electrical connection between the first conductive member 174 and the second conductive member 221, which facilitates the production and manufacturing of the connecting component 20 and the hairdressing head 2. Furthermore, in this embodiment, by configuring the driving mechanism 14, the hairdressing head 2 can be driven to rotate through the connecting component 20 during driving, facilitating the user's use when curling hair, and making it convenient for the user to curl hair.

Specifically, the hairdressing head 2 can be a hair straightener used for straightening hair or a curling iron with different diameters for curling hair. The first conductive member 174 can be arranged on the hairdressing head 2, and the second conductive member 221 can be arranged on the connecting component 20. Alternatively, the second conductive member 221 can be arranged on the hairdressing head 2, and the first conductive member 174 can be arranged on the connecting component 20.

In one embodiment, the connecting component 20 includes a first connecting member 10 and a second connecting member 15 both arranged on the handle 1. The hairdressing head 2 is detachably connected to the first connecting member 10. The driving mechanism 14 is connected to the first connecting member 10 after passing through the second connecting member 15. The second connecting member 15 is fixed on the handle 1, that is, the second connecting member 15 does not rotate with the driving of the driving mechanism 14. When the first connecting member 10 is driven by the driving mechanism 14, the first connecting member 10 rotates and drives the hairdressing head 2 to rotate.

The first conductive member 174 is arranged on the first connecting member 10, and the second conductive member 221 is arranged on the hairdressing head 2. The first connecting member 10 is provided with a conductive ring 160 on one side close to the second connecting member 15. The conductive ring 160 is used for conducting electricity and is in an annular shape. The conductive ring 160 is electrically connected to the first conductive member 174, and a center of the conductive ring 160 is positioned on a central axis of rotation of the hairdressing head 2. The second connecting member 15 is provided with a third conductive member 150 that has elasticity and is used for conducting electricity. The third conductive member 150 abuts against the conductive ring 160, and the third conductive member 150 is electrically connected to the first circuit board 13. That is, the first circuit board 13 passes through the third conductive member 150 and the conductive ring 160 in sequence and then is electrically connected to the first conductive member 174. When the driving mechanism 14 drives the first connecting member 10 to rotate, the first conductive member 174 and the conductive ring 160 can be made to rotate together. By using the annular conductive ring 160, the conductive ring 160 can always be electrically connected to the third conductive member 150, and the electrical connection between the third conductive ring 160 and the first circuit board 13 is not affected by rotation. Moreover, by using the elastic third conductive member 150, the third conductive member 150 can be in close contact with the conductive ring 160, preventing poor contact from affecting the heating of the heating member 26 driven by the first circuit board 13.

In one embodiment, both the second conductive member 221 and the third conductive member 150 are elastic probes, and the first conductive member 174 is a conductive column. By using the elastic probes, after the hairdressing head 2 is assembled with the connecting component 20, the first conductive member 174 can be in close contact with the second conductive member 221. Of course, in other embodiments, the second conductive member 221 and the third conductive member 150 may also be elastic sheets, and the first conductive member 174 may also be a metal sheet, an elastic sheet, or the like.

In one embodiment, a surface of the first conductive member 174 abutting against the second conductive member 221 is recessed towards one side away from the second conductive member 221. Specifically, a surface of the elastic probe is a convex curved surface. By arranging a recess in the first conductive member 174, the elastic probe can be placed inside the recess, thereby increasing a contact area between the first conductive member 174 and the second conductive member 221, and improving the reliability of the electrical connection between the first conductive member 174 and the second conductive member 221.

Specifically, a cross-section of the first conductive member 174 on the surface abutting against the second conductive member 221 is V-shaped. Of course, in other embodiments, a recessed shape of the surface of the first conductive member 174 abutting against the second conductive member 221 may also be a shape of a spherical surface that fits with the elastic probe.

In one embodiment, the hairdressing head 2 is provided with a connecting head 22 at one end near the handle 1, and an insertion end 222 is provided on the connecting head 22. The second conductive member 221 is provided on the insertion end 222. The connecting component 20 is provided with an insertion opening 181 used in conjunction with the insertion end 222. The first conductive member 174 is arranged inside the insertion opening 181. The second conductive member 221 abuts against the first conductive member 174 when the insertion end 222 is placed inside the insertion opening 181. When the hairdressing head 2 is assembling with the handle 1, placing the insertion end 222 inside the insertion opening 181 can increase a connection area between the hairdressing head 2 and the handle 1, thereby increasing the reliability of the connection between the hairdressing head 2 and the handle 1.

In one embodiment, the connecting head 22 is provided with an engaging opening 223 on an outer side corresponding to the insertion end 222, and the connecting component 20 is provided with an engaging member 183. One end of the engaging member 183 is provided on the first connecting member 10, and an opposite end of the engaging member 183 is provided with an engaging hook 184. The engaging member 183 is provided with a first pressing part 185 at a position near the engaging hook 184, and an avoidance opening 191 is defined in the first connecting member 10 for avoiding the first pressing part 185. When the insertion end 222 is placed in the insertion opening 181, the engaging hook 184 is placed in the engaging opening 223. When the first pressing part 185 is pressed, the engaging hook 184 is disengaged from the engaging opening 223.

When the hairdressing head 2 is assembled with the handle 1, that is, when the insertion end 222 is placed in the insertion opening 181, the engaging hook 184 can be placed in the engaging opening 223 to engage and fix the connecting head 22 with the first connecting member 10, so as to achieve the assembly of the hairdressing head 2 with the handle 1. Moreover, when the user needs to replace the hairdressing head 2, by pressing the first pressing part 185, the first pressing part 185 can drive the engaging hook 184 to detach from the engaging opening 223. At this time, the connecting head 22 can be detached from the first connecting member 10 to separate the hairdressing head 2 from the handle 1, thereby facilitating the installation of different hairdressing heads 2 on the handle 1.

In other embodiments, the connecting head 22 and the connecting component 20 are detachably connected by means of magnetic attraction or bolts or the like.

In one embodiment, in order to achieve the compactness of the structure of this embodiment and facilitate the production and manufacturing of the first connecting member 10, the first connecting member 10 includes a connecting seat 18, a second circuit board 17, and a position limiting bracket 16. The insertion opening 181 is defined in the connecting seat 18, the position limiting bracket 16 is arranged at an end of the connecting seat 18, and the second circuit board 17 is positioned between the position limiting bracket 16 and the connecting seat 18. The first conductive member 174 is arranged on the second circuit board 17, and the first conductive member 174 is partially placed inside the insertion opening 181. The conductive ring 160 is arranged on the position limiting bracket 16, and the driving mechanism 14 is connected to the position limiting bracket 16 after passing through the second connecting member 15.

In an embodiment with the engaging member 183, the engaging member 183 is provided on the connecting seat 18.

In one embodiment, the first conductive member 174, the second conductive member 221, the third conductive member 150, and the conductive ring 160 are all four in number. Each of the third conductive members 150 is electrically connected to one second conductive member 221 after passing through one conductive ring 160 and one first conductive member 174. The four conductive rings 160 are respectively a first ring 162, a second ring 161, a third ring 163, and a fourth ring 164. The first ring 162, the second ring 161, the third ring 163, and the fourth ring 164 are sequentially arranged on the position limiting bracket 16 at intervals from outside to inside, so as to separate the four conductive rings 160 through the position limiting bracket 16 and prevent the four conductive rings 160 from coming into contact. The four first conductive members 174 are spaced apart, the four second conductive members 221 are spaced apart, and the four third conductive members 150 are spaced apart. A temperature sensor 25 is also provided inside the hairdressing head 2. Two of the second conductive members 221 are electrically connected to a positive pole and a negative pole of the temperature sensor 25, and remaining two of the second conductive members 221 are electrically connected to a positive pole and a negative pole of the heating member 26, so that both the heating member 26 and the temperature sensor 25 on the hairdressing head 2 can be electrically connected to the first circuit board 13. Through the temperature sensor 25, a temperature of the hairdressing head 2 or the heating member 26 can be detected, so as to control a heating temperature of the heating member 26 and achieve temperature control of the hairdressing head 2. Specifically, assuming that when the user controls the temperature of the hairdressing head 2 or the heating member 26 to 75 degrees, the first circuit board 13 drives the heating member 26 to generate heat. When the temperature of the hairdressing head 2 or the heating member 26 reaches 75 degrees, the temperature sensor 25 detects the temperature of the hairdressing head 2 or the heating member 26 in real time and feeds back an electrical signal to the first circuit board 13. When a size of the electrical signal received by the first circuit board 13 reaches a size of an electrical signal corresponding to the temperature reaching 75 degrees, the first circuit board 13 stops driving the heating member 26 to generate heat. Moreover, when the size of the electrical signal received by the first circuit board 13 does not reach the size of the electrical signal corresponding to the temperature reaching 75 degrees, the first circuit board 13 continues to drive the heating member 26 to generate heat, so as to realize temperature control of the hairdressing head 2.

In one embodiment, an end of the position limiting bracket 16 is provided with a first column 165 and a second column 166 positioned outside the first column 165. The position limiting bracket 16 is provided with a first annular groove 168 and a second annular groove 167 on an outer side of the second column 166, and the first annular groove 168 and the second annular groove 167 are spaced apart. The first ring 162 is placed in the first annular groove 168, the second ring 161 is placed in the second annular groove 167, the third ring 163 is arranged on the second column 166, and the fourth ring 164 is arranged on the first column 165, so as to separate the four conductive rings 160. The position limiting bracket 16 is provided with passing holes 169 at positions corresponding to the first ring 162, the second ring 161, the third ring 163, and the fourth ring 164, respectively. The first ring 162, the second ring 161, the third ring 163, and the fourth ring 164 are each partially threaded through the passing holes 169 and then arranged on the second circuit board 17, that is, the first ring 162, the second ring 161, the third ring 163 and the fourth ring 164 are realized to be electrically connected to the second circuit board 17. By using the wiring on the second circuit board 17, the first ring 162, the second ring 161, the third ring 163, and the fourth ring 164 can each be electrically connected to one first conductive member 174. Through the above structure, this embodiment can be made compact in structure and have a reasonable layout, which can allow each of the four conductive rings 160 to be electrically connected to one first conductive member 174.

In one embodiment, an end of the second connecting member 15 is provided with a third circuit board 151. The third conductive member 150 is provided on the third circuit board 151. The third circuit board 151 is electrically connected to the first circuit board 13.

In one embodiment, the third ring 163 is sleeved on an outer side wall of the second column 166, and the fourth ring 164 is sleeved on an outer side wall of the first column 165. The four third conductive members 150 are respectively a first probe 152, a second probe 155, a first clamping member 153, and a second clamping member 154. The first probe 152 abuts against the first ring 162, and the second probe 155 abuts against the second ring 161. The first clamping member 153 includes a first base 1531 and two first clamping arms 1532 extending from both sides of the first base 1531, and the two first clamping arms 1532 so formed are elastic. The two first clamping arms 1532 are clamped on an outer side wall of the third ring 163. The second clamping member 154 includes a second base 1542 and two second clamping arms 1541 extending from both sides of the second base 1542, and the second clamping arms 1541 so formed are elastic. The two second clamping arms 1541 are clamped on an outer side wall of the fourth ring 164. Thus, the conductive ring 160 can always be electrically connected to the third conductive member 150, and the electrical connection between the third conductive ring 160 and the first circuit board 13 is not affected by the rotation of the connecting component 20. Specifically, the first probe 152 and the second probe 155 are elastic probes.

In one embodiment, the first connecting member 10 further includes a connecting outer sleeve 19. The connecting outer sleeve 19 is connected to the connecting seat 18. The connecting outer sleeve 19 is positioned at one end of the handle 1 near the hairdressing head 2, and the avoidance opening 191 is defined in the connecting outer sleeve 19. When the driving mechanism 14 is driven, the connecting outer sleeve 19 can be driven to rotate together through the limiting bracket 16, the second circuit board 17, and the connecting seat 18. Moreover, by configuring the connecting outer sleeve 19, the engaging hook 184 can be hidden inside the connecting outer sleeve 19, and combined with the avoidance opening 191, the first pressing part 185 can be displayed on an outside, so that the first pressing part 185 can be easily used by the user.

In one embodiment, the handle 1 is provided with a first position limiting block 117, and an outer side wall of the first connecting member 10 is provided with a second position limiting block 182. The second position limiting block 182 is positioned on one side of the first position limiting block 117 close to the hairdressing head 2. Specifically, the second position limiting block 182 is positioned on an outer side wall of the connecting seat 18. By using the first position limiting block 117 in conjunction with the second position limiting block 182, when the driving mechanism 14 drives the first connecting member 10, the first connecting member 10 will not detach from the handle 1, improving the position limitation of the first connecting member 10 and enhancing the compactness of the structure of this embodiment.

In the above embodiment, the driving mechanism 14 is a motor, and the first circuit board 13 is positioned at one end of the driving mechanism 14 away from the hairdressing head 2, so as to shorten a distance between the first circuit board 13 and the motor, and a distance between the first circuit board 13 and the third circuit board 151, and to shorten a length of a wire electrically connected between the first circuit board 13 and the motor, and a length of a wire electrically connected between the first circuit board 13 and the third circuit board 151.

The handle 1 is equipped with a power cord 12 for connecting to a power source. The power cord 12 is electrically connected to the first circuit board 13. By using the power cord 12 to connect to the power source, the first circuit board 13 can be powered on for operation.

In one embodiment, the handle 1 is equipped with a temperature operating member 115 for adjusting a heating temperature of the heating member 26 and a direction operating member 113 for controlling a rotation direction of the driving mechanism 14. Both the temperature operating member 115 and the direction operating member 113 are electrically connected to the first circuit board 13. By operating the temperature operating member 115, the heating temperature of the heating member 26 can be controlled through the first circuit board 13, achieving temperature control of the hairdressing head 2. By operating the direction operating member 113, the motor can be controlled to rotate clockwise or counterclockwise through the first circuit board 13, so that the user can control a direction of rotation of the hairdressing head 2 according to a direction of curling hair, thereby enhancing the user's experience of using the hairdressing device of this embodiment.

In one embodiment, the handle 1 is also provided with a restoration operating member 114 for restoring to an initial state and a speed adjusting operating member 116 for adjusting a rotational speed of output of the driving mechanism 14. The restoration operating member 114 and the speed adjusting operating member 116 are both electrically connected to the first circuit board 13. By operating the speed adjusting operating member 116, the rotational speed of output of the driving mechanism 14 can be changed to allow the user to adjust a desired speed for curling hair. In the initial state of the hairdressing device 100 in this embodiment, values of the rotational speed and the temperature of the driving mechanism 14 are preset values. When the user adjusts the temperature and the rotational speed through the temperature operating member 115 and the speed adjusting operating member 116 respectively, and then needs to restore the values of the rotational speed and the temperature of the driving mechanism 14 to the initial state, the user can operate the restoration operating member 114, so as to restore the values of the rotational speed and the temperature of the driving mechanism 14 to the preset values in the initial state through the first circuit board 13.

In the above embodiment, in order to facilitate the production and manufacturing of the handle 1, and to facilitate the assembly of the first circuit board 13, the connecting component 20, and the driving mechanism 14 with the handle 1, the handle 1 includes a first housing 111 and a second housing 112 connected to the first housing 111. The first housing 111 and the second housing 112 are connected to accommodate the first circuit board 13, the connecting component 20, and the driving mechanism 14. The temperature operating member 115, the direction operating member 113, the speed adjusting operating member 116, and the restoration operating member 114 can all be one of the switch buttons, dip switches, etc.

In one embodiment, the connecting head 22 is rotationally provided with a clamping member 21 used in conjunction with the hairdressing head 2 for clamping hair. By rotating the clamping member 21 and the connecting head 22, the clamping member 21 can be used in conjunction with the hairdressing head 2 to clamp hair, allowing the user to style hair.

In one embodiment, the clamping member 21 is provided with a second pressing part 211 at a position near the handle 1. The second pressing part 211 is arranged on the connecting head 22 through a shaft rod 213, and a torsion spring 212 is sleeved on the shaft rod 213. Two ends of the torsion spring 212 respectively abut against the second pressing part 211 and the connecting head 22. When the user presses the second pressing part 211, the clamping member 21 can be separated from the hairdressing head 2. When the second pressing part 211 is released, under the action of the torsion spring 212, the clamping member 21 can be brought closer to the hairdressing head 2 and clamp hair together with the hairdressing head 2.

In one embodiment, the hairdressing head 2 includes a hair curling cylinder 23 and two heat-conducting members 24. The heating member 26 and the heat-conducting member 24 are both disposed inside the hair curling cylinder 23, and the heating member 26 is positioned between the two heat-conducting members 24. Two side surfaces of the heating member 26 are in contact with the two heat-conducting members 24, respectively. The two heat-conducting members 24 both abut against the hair curling cylinder 23. The connecting head 22 is disposed at one end of the hair curling cylinder 23. By using the heat-conducting member 24, heat on the heating member 26 can be conducted to the hair curling cylinder 23, so that the user can style the hair.

In one embodiment, each of the heat-conducting members 24 includes a base plate 242 and two arc-shaped front plates 241 formed by extending upward from both sides of the base plate 242. The two arc-shaped front plates 241 both abut against an inner side wall of the hair curling cylinder 23, and the heating member 26 is positioned between the two base plates 242 and is in contact with the base plates 242. In this way, when the heating member 26 generates heat, the heat can be effectively transferred to the hair curling cylinder 23 through the base plate 242 and the arc-shaped front plate 241, so as to effectively utilize a heat energy generated by the heating member 26.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A hairdressing device, comprising:

a handle; and a hairdressing head;

wherein the handle is equipped with a first circuit board, a driving mechanism, and a connecting component; the hairdressing head is detachably connected to the connecting component; the connecting component is connected to the driving mechanism; the driving mechanism is electrically connected to the first circuit board; and the hairdressing head rotates together when the driving mechanism drives the connecting component to rotate;

a heating member for heating is provided on the hairdressing head; a conductive component is provided between the hairdressing head and the connecting component; the conductive component comprises first conductive members for conducting electricity and second conductive members for conducting electricity and having elasticity; and the first conductive member abuts against the second conductive member when the hairdressing head is assembled with the handle;

wherein the connecting component comprises a first connecting member and a second connecting member both arranged on the handle; the hairdressing head is detachably connected to the first connecting member; the driving mechanism is connected to the first connecting member after passing through the second connecting member; and the second connecting member is fixed on the handle;

the first conductive member is arranged on the first connecting member; the second conductive member is arranged on the hairdressing head; the first connecting member is provided with a conductive ring on one side close to the second connecting member, and the conductive ring is used for conducting electricity and is in an annular shape; the conductive ring is electrically connected to the first conductive member; a center of the conductive ring is positioned on a central axis of rotation of the hairdressing head; the second connecting member is provided with a third conductive member that has elasticity and is used for conducting electricity; the third conductive member abuts against the conductive ring; the third conductive member is electrically connected to the first circuit board; and when the driving mechanism drives the first connecting member to rotate, the hairdressing head rotates;

wherein the hairdressing head is provided with a connecting head at one end near the handle; an insertion end is provided on the connecting head; the second conductive member is provided on the insertion end; the connecting component is provided with an insertion opening used in conjunction with the insertion end; the first conductive member is arranged inside the insertion opening; and the second conductive member abuts against the first conductive member when the insertion end is placed inside the insertion opening;

wherein the connecting head is provided with an engaging opening on an outer side corresponding to the insertion end; the connecting component is provided with an engaging member; one end of the engaging member is provided on the first connecting member; an opposite end of the engaging member is provided with an engaging hook; the engaging member is provided with a first pressing part at a position near the engaging hook; and an avoidance opening is defined in the first connecting member for avoiding the first pressing part;

when the insertion end is placed in the insertion opening, the engaging hook is placed in the engaging opening; and when the first pressing part is pressed, the engaging hook is disengaged from the engaging opening;

wherein the first connecting member comprises a connecting seat, a second circuit board, and a position limiting bracket; the insertion opening is defined in the connecting seat; the position limiting bracket is arranged at an end of the connecting seat; the second circuit board is positioned between the position limiting bracket and the connecting seat; the first conductive member is arranged on the second circuit board; the first conductive member is partially placed inside the insertion opening; the conductive ring is arranged on the position limiting bracket; and the driving mechanism is connected to the position limiting bracket after passing through the second connecting member;

wherein the first conductive member, the second conductive member, the third conductive member, and the conductive ring are each four in number; and each of the third conductive members is electrically connected to one second conductive member after passing through one conductive ring and one first conductive member;

wherein the conductive rings comprises a first ring, a second ring, a third ring, and a fourth ring; and the first ring, the second ring, the third ring, and the fourth ring are sequentially arranged on the position limiting bracket at intervals from outside to inside;

a temperature sensor is also provided inside the hairdressing head; two of the second conductive members are electrically connected to a positive pole and a negative pole of the temperature sensor; and remaining two of the second conductive members are electrically connected to a positive pole and a negative pole of the heating member.

2. The hairdressing device according to claim 1, wherein both the second conductive members and the third conductive members are elastic probes; and the first conductive members are conductive columns.

3. The hairdressing device according to claim 2, wherein surfaces of the first conductive members abutting against the second conductive members are recessed towards one side away from the second conductive members.

4. The hairdressing device according to claim 1, wherein an end of the position limiting bracket is provided with a first column and a second column positioned outside the first column; the position limiting bracket is provided with a first annular groove and a second annular groove on an outer side of the second column; and the first annular groove and the second annular groove are spaced apart;

the first ring is placed in the first annular groove; the second ring is placed in the second annular groove; the third ring is arranged on the second column; and the fourth ring is arranged on the first column;

the position limiting bracket is provided with passing holes at positions corresponding to the first ring, the second ring, the third ring, and the fourth ring, respectively; the first ring, the second ring, the third ring, and the fourth ring are each partially threaded through the passing holes and then arranged on the second circuit board; and the first ring, the second ring, the third ring, and the fourth ring are each electrically connected to one first conductive member.

5. The hairdressing device according to claim 1, wherein an end of the second connecting member is provided with a third circuit board; the four third conductive members are provided on the third circuit board; and the third circuit board is electrically connected to the first circuit board.

6. The hairdressing device according to claim 5, wherein the third ring is sleeved on an outer side wall of the second column; and the fourth ring is sleeved on an outer side wall of the first column;

the four third conductive members are respectively a first probe, a second probe, a first clamping member, and a second clamping member; the first probe abuts against the first ring; and the second probe abuts against the second ring;

the first clamping member comprises a first base and two first clamping arms extending from both sides of the first base; and the two first clamping arms are clamped on an outer side wall of the third ring;

the second clamping member comprises a second base and two second clamping arms extending from both sides of the second base; and the two second clamping arms are clamped on an outer side wall of the fourth ring.

7. The hairdressing device according to claim 1, wherein the first connecting member further comprises a connecting outer sleeve; the connecting outer sleeve is connected to the connecting seat; the connecting outer sleeve is positioned at one end of the handle near the hairdressing head; and the avoidance opening is defined in the connecting outer sleeve.

8. The hairdressing device according to claim 1, wherein the handle is provided with a first position limiting block; an outer side wall of the first connecting member is provided with a second position limiting block; and the second position limiting block is positioned on one side of the first position limiting block close to the hairdressing head.

9. The hairdressing device according to claim 8, wherein the driving mechanism is a motor; the first circuit board is positioned at one end of the driving mechanism away from the hairdressing head; the handle is equipped with a power cord for connecting to a power source; and the power cord is electrically connected to the first circuit board.

10. The hairdressing device according to claim 1, wherein the handle is equipped with a temperature operating member for adjusting a heating temperature of the heating member, a direction operating member for controlling a rotation direction of the driving mechanism, a restoration operating member for restoring to an initial state, and a speed adjusting operating member for adjusting a rotational speed of output of the driving mechanism; and the temperature operating member, the direction operating member, the restoration operating member, and the speed adjusting operating member are all electrically connected to the first circuit board.

11. The hairdressing device according to claim 1, wherein the connecting head is rotationally provided with a clamping member used in conjunction with the hairdressing head for clamping hair.

12. The hairdressing device according to claim 11, wherein the clamping member is provided with a second pressing part at a position near the handle; the second pressing part is arranged on the connecting head through a shaft rod; a torsion spring is sleeved on the shaft rod; and two ends of the torsion spring respectively abut against the second pressing part and the connecting head.

13. The hairdressing device according to claim 11, wherein the hairdressing head comprises a hair curling cylinder and two heat-conducting members; the heating member and the heat-conducting members are both disposed inside the hair curling cylinder; the heating member is positioned between the two heat-conducting members; two side surfaces of the heating member are in contact with the two heat-conducting members, respectively; the two heat-conducting members both abut against the hair curling cylinder; and the connecting head is disposed at one end of the hair curling cylinder.

14. The hairdressing device according to claim 13, wherein each of the heat-conducting members comprises a base plate and two arc-shaped front plates formed by extending upward from both sides of the base plate; the two arc-shaped front plates both abut against an inner side wall of the hair curling cylinder; and the heating member is positioned between the two base plates and is in contact with the base plates.

* * * * *